United States Patent [19]

Vincent et al.

[11] Patent Number: 5,041,846

[45] Date of Patent: Aug. 20, 1991

[54] HEATER ASSEMBLY FOR PRINTERS

[75] Inventors: Kent D. Vincent, Cupertino; John P. Ertel, Portola Valley, both of Calif.

[73] Assignee: Hewlett-Packard Company, Palo Alto, Calif.

[21] Appl. No.: 523,190

[22] Filed: May 15, 1990

Related U.S. Application Data

[63] Continuation of Ser. No. 285,905, Dec. 16, 1988, abandoned.

[51] Int. Cl.[5] ..... B41J 2/01

[52] U.S. Cl. ..... 346/25; 346/140 R

[58] Field of Search ..... 346/140, 25; 101/424.1, 101/487, 788

[56] References Cited

U.S. PATENT DOCUMENTS

| | | | |
|---|---|---|---|
| 4,340,893 | 7/1982 | Ort | 346/25 X |
| 4,469,026 | 9/1984 | Irwin | 346/25 X |
| 4,521,785 | 6/1985 | Matsufujii | 346/25 |
| 4,728,963 | 3/1988 | Rasmussen | 346/25 |
| 4,774,523 | 9/1988 | Beaufort | 346/25 |

FOREIGN PATENT DOCUMENTS 188684 4/1983 Japan .

*Primary Examiner*—Joseph W. Hartary

[57] ABSTRACT

In an inkjet printer, heaters are mounted to travel with an inkjet pen to expose print lines on sheets to localized heat substantially simultaneously with printing. After printing, sheets are ironed with a heated roller member to further dry ink and to prevent cockling.

13 Claims, 2 Drawing Sheets

HEATER ASSEMBLY FOR PRINTERS

This application is a continuation of application Ser. No. 07/285,905, filed Dec. 16, 1988, now abandoned.

BACKGROUND OF THE INVENTION

1. Technical Field

The present invention generally relates to printers and, more particularly, to inkjet printers in which aqueous ink is applied to a porous sheet medium such as paper.

2. Background Art

Conventional inkjet printers include inking devices, generally referred to as "pens," for depositing ink droplets on sheets to be printed. Normally, the droplets contain an aqueous fraction which, after printing, must be evaporated to permanently fix the ink to the printed sheets. With the increased use of highly aqueous inks, many having water contents approaching one-hundred percent by weight, several printing problems have arisen. One such problem is that highly aqueous inks cause wetted fibers on the printed face of a sheet to swell to a substantially greater extent than dry fibers on the obverse side of the sheet. Such an effect, often described as differential expansion, results in wrinkle-like bulges, or cockles, in sheets. When printing on ordinary paper, cockling can occur as rapidly as 600 milliseconds (ms) after aqueous ink is applied.

Also, highly aqueous inks cause difficulties in sheet drying. Conventionally, the drying of ink on printed sheets entails applying heat after entire sheets are printed. This practice has several disadvantages in the case of highly aqueous inks. For instance, in the interval while a printed sheet is transported from a printing station to a drying station, highly aqueous inks are quite susceptible to smearing. Also, highly aqueous inks often bleed into paper fibers before drying is complete. Such bleeding can detrimentally affect the appearance of text or graphics printed on a sheet and, also, can adversely affect the appearance of the obverse side of a printed sheet.

The highly aqueous nature of many modern inks can also adversely affect the efficiency of inkjet printers. For example, to provide adequate time for highly aqueous inks to dry, the printing speed of an inkjet printer may have to be slowed or else the size of the driers on the printer may have to be increased. Although the temperature of driers can be increased to dry ink more quickly, there are limits beyond which temperature cannot be elevated without scorching printed sheets.

In addition to the problems mentioned above, there are less obvious ways in which highly aqueous inks may adversely affect inkjet printing. For example, because inkjet printing normally proceeds sequentially from location to location across a sheet surface, cockling at one location can adversely affect pen-to-sheet spacing during printing at adjacent locations. Pen-to-sheet spacing is especially critical in bi-directional inkjet printing (i.e., in inkjet printers that print swaths of ink drops while moving both from right-to-left and from left-to-right across the surface of a sheet). In bi-directional printing, print defects are usually perceptible unless pen-to-sheet spacing distance is held constant to tolerances of about ±0.0025 inch.

In view of the preceding discussion, it can be appreciated that there exists a need in the inkjet printing art for improved ways and means to minimize cockling and to prevent highly aqueous inks from bleeding and smearing before drying.

SUMMARY OF THE INVENTION

The present invention generally provides an inkjet printing assembly comprising an inkjet pen and heater means for heating localized areas of sheets along print lines so that ink, upon ejection from the inkjet pen, is substantially immediately exposed to elevated temperature. In the preferred embodiment, the heater means comprises first and second heaters mounted to heat each print line immediately in advance of inking and immediately after inking. Further in the preferred embodiment, the inkjet pen and the two heaters are mounted to travel back and forth across a sheet during printing.

In another embodiment, an auxiliary heating means is arranged at a location spaced from the inkjet pen for heating printed surfaces of printed sheets. Preferably, the auxiliary heating means comprises a pair of roller members, at least one of which is heated, mounted to subject printed sheets to an ironing action for removing cockles from the sheets.

BRIEF DESCRIPTION OF THE DRAWINGS

Various features and advantages of the present invention can be appreciated from the following description in conjunction with the appended drawings, in which.

DETAILED DESCRIPTION OF THE BEST MODE OF CARRYING OUT THE INVENTION

Figure 1:
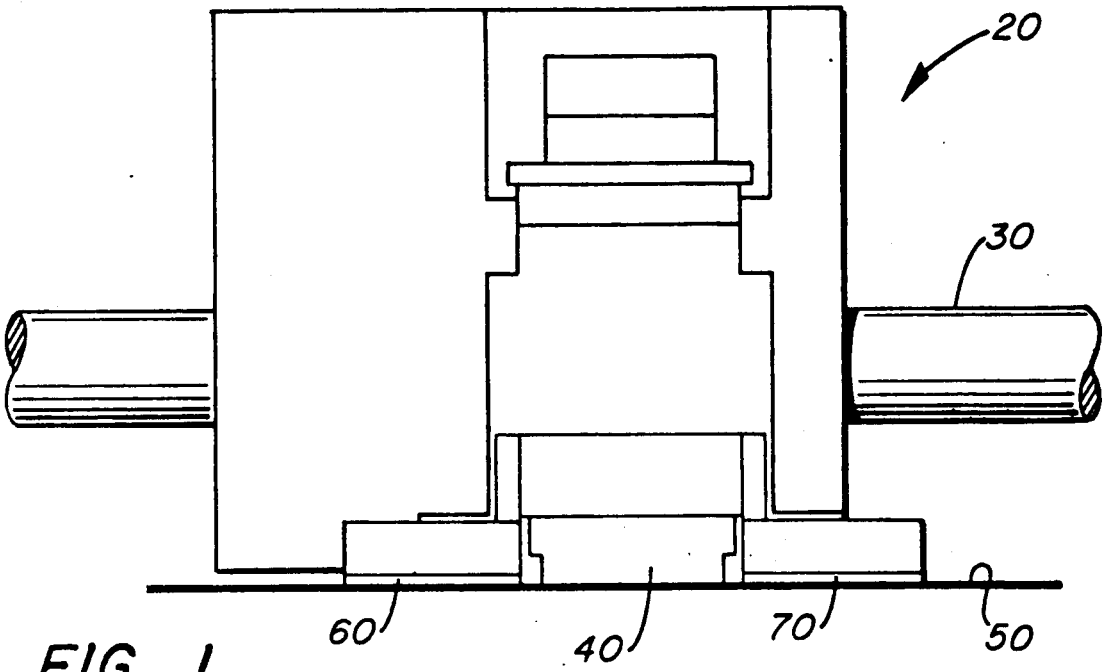
FIG. 1 is a frontal view of an inkjet printing assembly according to the present invention.

FIG. 1 generally shows an inkjet pen carriage 20, sometimes referred to as a "print head". Carriage 20 is slidably mounted on a guide shaft 30 and is adapted to carry one or more inkjet pens 40 disposed to form print lines on the surface of a sheet 50. More particularly, carriage 20 is supported by guide shaft 30 so that inkjet pen 40 can traverse back and forth across sheet 50 in a direction perpendicular to the sheet edges while remaining parallel to the sheet surface. (In terms of FIG. 1, the traversing motion would be parallel to the axial center line of guide shaft 30.) A motor-driven device such as a band or belt is mechanically coupled to drive carriage 20 to drive it back and forth on guide shaft 30.

As shown in FIG. 1, carriage 20 carries a heater 60, such as a wire filament type heater, attached adjacent one side of inkjet pen 40 to face the surface of sheet 50 while being proximately spaced therefrom. Preferably, at least one additional heater 70 is mounted adjacent the side of inkjet pen 40 opposite first heater 60. Thus, in the illustrated embodiment, both heaters 60 and 70 face the surface of sheet 50. In practice, the two heaters need not be separate but can be a single heater configured to wrap-around the inkjet pens to heat each print line both immediately before and immediately after inking by the inkjet pen.

Operation of the system of FIG. 1 will now be generally described. Initially, it should be assumed that the inkjet printer is of the bi-directional type so that inkjet pen 40 prints swaths of ink drops across the surface of sheet 50 while carriage 20 moves both back and forth along guide shaft 30. In each swath, ink dots are printed in columns; a row of columns covers a sheet as referred to herein as a "print line". Normally, between each change in printing direction, the printed sheet is indexed to provide generally equal spacing between print lines. (In terms of FIG. 1, the sheet indexing direction would be perpendicular to the plane of the drawing.)

Because heaters 60 and 70 are attached to carriage 20 in the embodiment of FIG. 1, the heaters pass directly over each print line on the surface of sheet 50 before and after inkjet pen 40 has deposited ink on the line. Thus, the leading heater on the carriage convectively heats the surface of sheet 50 in localized areas ahead of each print line. Then, the trailing heater begins drying each print line almost immediately (i.e., within about fifty milliseconds) after ink is applied. Accordingly, the system of FIG. 1 functions to dry printed lines before ink droplets forming the lines can bleed substantially into the sheet fibers, or merge with adjacent ink droplets, or cause cockling.

In operating the inkjet print head of FIGURE 1, the temperature to which localized areas along print lines are heated is controlled by the temperature of heaters 60 and 70. Normally, the temperature of each heater is controlled by varying the electrical current applied through the heater filaments. For example, for printing on plain paper, localized areas on the sheet surface normally are not heated above the browning point, about 160° C.

Figure 2:
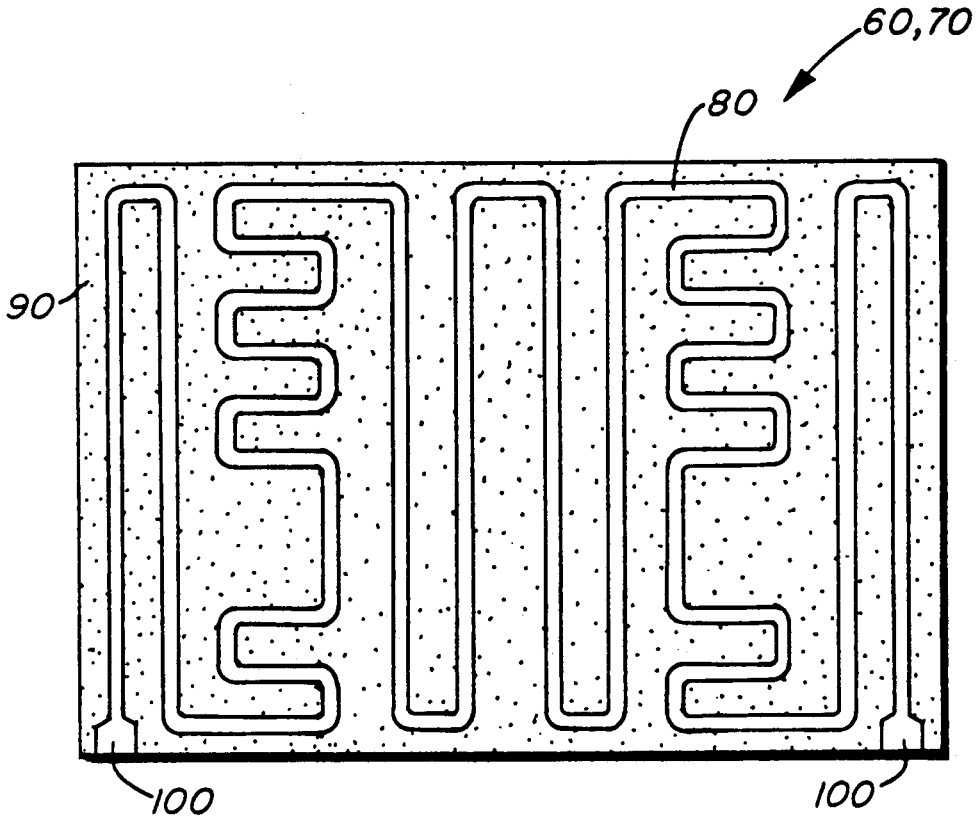
FIG. 2 is a bottom plan view of one configuration of a heater included in the assembly of FIG. 1.

FIG. 2 shows one example of a particular configuration of heaters 60 and 70. In this configuration, each heater comprises a heating filament 80 which extends over the planar face of a supporting substrate 90 between electrical terminal pads 100. Also in the illustrated embodiment, filament 80 has a resistance metallization pattern which can be generally described as serpentine or meandering. Preferably, substrate 90 is formed of an electrically and thermally insulating material so that heat from filament 80 does not cause dimensional distortion of either inkjet pan 40 or carriage 20. Substrate 90 is usually formed of ceramic alumina and filament 80 is usually formed of tungsten. In practice, it is preferred to coat the substrate and filament with a thin protective layer of glass.

Normally, the planar surfaces of the substrates 90 are mounted parallel to the surface to be printed, generally at an elevation of about two millimeters or less above the print lines. In practice, such spacing provides substantial convective heating of the sheet surface as well as radiant heating. Because heat is transferred to sheet 50 primarily by forced convention, the transfer mechanism can be augmented by blowing air through the space between heater and the sheet surface.

Figure 3:
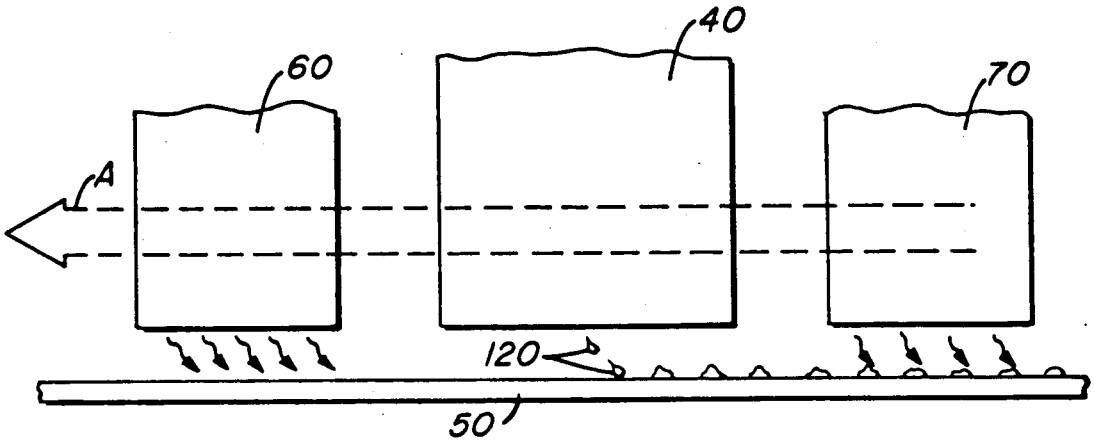
FIG. 3 is a schematic diagram illustrating operation of the assembly of FIG. 1 when viewed in the direction of paper travel.

Operation of heaters 60 and 70 can be further understood from FIG. 3, which schematically shows inkjet pen 40 traversing sheet 50 in the direction of arrow A while selectively depositing ink droplets 120 onto the surface of sheet. (In FIG. 3, the direction of sheet indexing would be into, or out of, the page.) In travel direction A, heater 60 leads pen 40 and prewarms localized areas along each print line. As each localized area is prewarmed, surface moisture is both evaporated and driven into sub-surface regions of sheet 50. Thus, when ink droplets 120 are ejected from pen 40, they contact warm, dry fibers on the sheet surface and begin to dry immediately.

FIG. 3 further shows that heater 70 follows pen 40 along each print line in travel direction A. Thus, trailing heater 70 functions to evaporatively dry and immobilize the deposited ink droplets 120 which form each print line. Additionally, heat from trailing heater 70 drives liquid binders from the ink droplets into the sheet fibers at, and below, the sheet surface. This latter effect enhances the appearance of print and has the practical benefit of reducing ink smearing when a printed sheet is subsequently handled or transported. Furthermore, by driving ink moisture into the bulk of a sheet, trailing heater 70 assists in reestablishing a generally uniform moisture profile through a printed sheet, thereby reducing the tendency of the sheet to cockle. Still further, it should be noted that heaters 60 and 70 convectively warm the air near inkjet pen 40 and, therefore, assist in preventing condensation of moisture onto the pen.

In practice, carriage-mounted heaters 60 and 70 are smaller in size than conventional, stationary driers. The smaller size of the carriage-mounted heaters results from the fact that stationary driers have the more difficult task of removing moisture which has penetrated into a sheet, while the carriage-mounted heaters have the less difficult task of only drying applied ink sufficiently to prevent puddling. Tests have shown that the combined vaporization of surface moisture and more uniform distribution of moisture within sheets when using carriage-mounted heaters account for substantial reduction in paper cockle. In practical effect, usage of carriage-mounted heaters reduces or eliminates the need for large stationary driers on inkjet printers. Thus, by employing carriage-mounted heaters, the size of inkjet printer can be reduced while maintaining high print quality and normal printing speeds.

Figure 4:
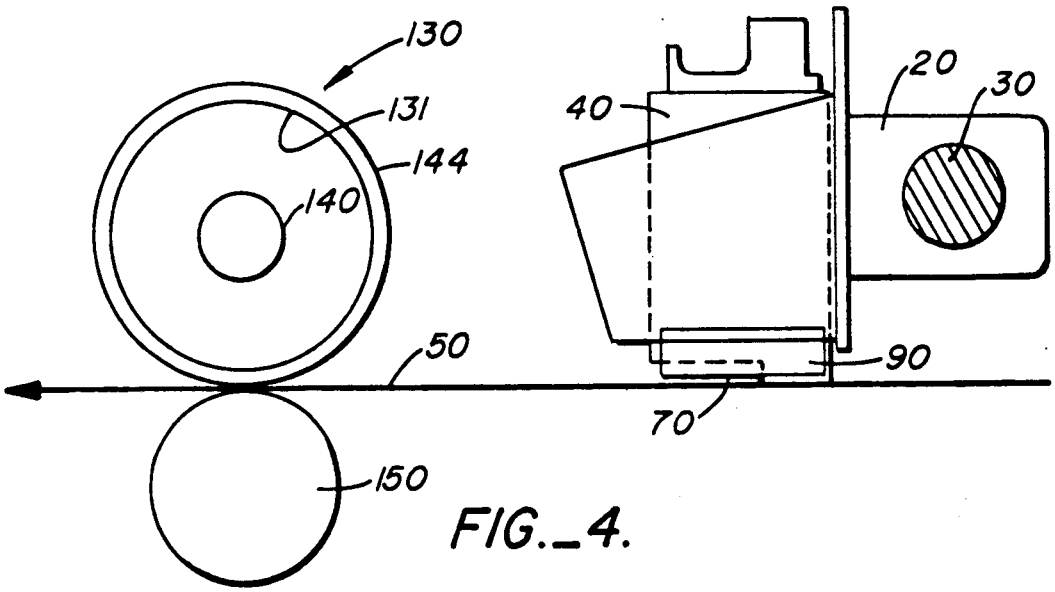
FIG. 4 is a side profile view of the assembly of FIG. 1 in combination with an auxiliary heater assembly.

FIG. 4 shows a combination of the above-described carriage-mounted heaters with a roller-type heater, generally designated by number 130. In practice, the system of FIG. 4 can be particularly effectively employed when graphics are printed which have large, highly inked areas. In such applications, even though carriage-mounted heaters can be operated to sufficiently dry ink to avoid smearing, further heating of a printed sheet often is needed to remove residual ink moisture and to remove cockles which form because of the residual moisture.

In the embodiment illustrated in FIG. 4, roller-type heater 130 is a hollow, elongated cylindrical member 131 which is mounted to extend parallel to the direction of guide shaft 30 while being positioned in rolling contact with sheet 50 after inkjet printing. In the preferred embodiment, cylindrical member 131 is formed of metal and is covered with a thermally conducting non-sticky material 144, such as teflon. Mounted along the axis of cylinder 131 is a heat lamp 140. Also in the preferred embodiment, a pressure roller 150 is located on the obverse side of sheet 50 opposite roller-type heater 130 so that the sheet is engaged at the nip between the two rollers. Pressure roller 150 can be heated in addition to, or instead of, roller 130.

Operation of the system of FIG. 4 Will now be described. Initially, it should be assumed that rollers 130 and 150 are driven by a common drive, have the same surface speed, and are biased together with sufficient pressure to drive sheet 50 without slippage. It may be assumed also that sheet 50 has not been dried completely by action of carriage-mounted heaters 60 and 70 which travel with inkjet pen 40 on carriage 20, but that sufficient moisture has been removed from the sheet that beads of ink do not form ahead of the nip between rollers 130 and 150. Then, when lamp 140 is energized to radiantly heat roller 130 (usually to a temperature ranging from about 160° C. to about 190° C.), sheet 50 is heated by heat conduction as it travels through the nip between rollers 130 and 150. The temperature to which sheet 50 is heated is generally a function of the temperatures of the rollers and the travel speed of the sheet. Together, the pressure and heat along the nip between rollers 130 and 150 provide an ironing effect which removes moisture to fully dry the printed sheet and which flattens cockles in the sheet, thereby assuring that the printed sheet has an acceptable appearance.

At this juncture, it should again be emphasized that, in the system of FIG. 4, the carriage-mounted heaters normally are not operated to completely dry print lines before a printed sheet is operated upon by the roller-type heater 130. This is done because retained bulk moisture has been found to be important for the removal of cockle by the roller-type heaters. The explanation for this effect appears to be that retained moisture swells fibers in sheets to increase the overall volume of the sheet and to, thereby, allow space for fiber realignment and sheet flattening when a partially dried sheet is operated upon by the roller-type heaters. Thus, combined use of carriage-mounted heaters and roller-type heaters often provides a synergistic effect.

Although the present invention has been described in terms of specific embodiments and modes of operation, the description should be regarded as illustrative rather than limitative. Thus, workers of ordinary skill in the art will appreciate that the invention may be otherwise embodied or practiced. For example, while the foregoing description of the best mode of carrying out the invention was presented in connection with an inkjet printing of paper sheets, and it may be in such an application that the advantages of the invention are most fully realized, the invention may also prove useful in connection with other types of printers and with various media.

As a particular example of an alternative within the scope of the present invention, workers skilled in the art will recognize that inkjet printing can be accomplished with print heads that do not travel but, instead, extend stationarily across the full width of a traveling sheet to be printed. In such an embodiment, the above-described heaters 60 and 70 would be stationarily arranged immediately before and immediately after the print heads in the direction of sheet travel.

As yet another example of an alternative within the scope of the present invention, workers skilled in the art will recognize that the system of FIG. 4 can be operated with roller members 130 and 150 driven continuously or incrementally. In the case where it is desired to continuously drive roller members 130 and 150 when a sheet moves incrementally (i.e., when a sheet is indexed), the roller members can be located to follow, for example a path compliance loop which provides a buffer between the rollers and the printing station.

What is claimed is:

1. A printing assembly for an inkjet printer, comprising:

inkjet pen means for providing aqueous ink droplets that form print porous sheet medium such as paper sheets, which ink droplets contain sufficient moisture to cause cockling;

a first heater for heating localized areas of the sheets along the print lines;

a second heater mounted such that the inkjet pen means is disposed between the first and second heaters;

support means for supporting the pen means and the first and second heaters proximate the surface of a sheet to be printed so that ink, upon ejection from the pen means to form a print line, is substantially immediately exposed along the print line to localized heat from the first and second heaters, which heat is sufficient to only partially dry the printed porous sheet medium; and an auxiliary heating means arranged at a location substantially spaced from the inkjet pen means for heating the sheet surface after printing, the auxiliary heating means including a first heated roller member for rolling across the printed surfaces of printed sheets and a second roller member mounted opposite the first roller member such that printed sheets are pressed between the first and second roller members such that the pressure and heat along the nip between the first heated roller member and the second roller member provide an ironing effect that removes moisture to fully dry the printed porous sheet medium and to flatten cockles therein.

2. A printing assembly according to claim 1 wherein the first heater is mounted to the support means for heating localized areas of a sheet surface immediately in advance of inking by the pen means.

3. A printing assembly according to claim 1 wherein the first and second heaters operate to heat each print line both immediately before and immediately after inking by the inkjet pen means.

4. A printing assembly according to claim 1 wherein the inkjet pen means is mounted for translational motion back and forth across the surface of a sheet to be printed.

5. A printing assembly according to claim 4 wherein the first and second heaters are mounted to the support means to travel with the inkjet pen means.

6. A printing assembly according to claim 1 wherein the inkjet pen means and the first and second heaters are stationary.

7. A printing assembly according to claim 1 wherein the second roller member is heated.

8. A printing assembly for printers such as inkjet printers, comprising:

inkjet pen means for delivering aqueous ink droplets for printing on a porous sheet media such as paper sheets, which ink droplets contain sufficient moisture to cause cockling;

carriage means for transporting the pen means back and forth parallel to the surface of a sheet to form print lines on the sheet surface;

heater means mounted to the carriage means for travel with the pen means for heating localized areas along the print lines so that ink, upon ejection from the pen means, is substantially immediately exposed to elevated temperatures which temperatures are sufficient to only partially dry the printed porous sheet medium, said heater means comprising first and second heaters mounted on opposite sides of the pen means to heat each print line both immediately before and immediately after it is formed by the pen means; and an auxiliary heating means arranged at a location substantially spaced from the heater means for heating printed sheet surfaces after printing, said auxiliary heating means including first and second roller members mounted opposite one another so that printed sheets pass through the nip area between the two roller members such that the pressure and heat along the nip between the first heated roller member and the second roller member provide an ironing effect that removes moisture to fully dry the printed porous sheet medium and to flatten cockles therein.

9. A printing assembly according to claim 8 wherein the carriage means includes a guide shaft that extends parallel to the surface of a sheet during printing and a carriage member slidably mounted on the guide shaft.

10. A printing assembly according to claim 8 wherein the first roller member is heated.

11. A printing assembly according to claim 8 wherein both the first and second roller members are heated.

12. A printing system for printing inkdot patterns on sheets, comprising:

a carriage arranged to move in a first direction parallel to the surface of a sheet to be printed;

an inkjet pen transported by the carriage for delivering aqueous ink droplets for printing on a porous sheet media such as paper sheets, which ink droplets contain sufficient moisture to cause cockling;

first heater means mounted on the carriage to travel with the inkjet pen for heating each print line immediately prior to the time at which ink is ejected from the inkjet pen onto the line;

second heater means mounted on the carriage to travel with the inkjet pen for heating localized areas of each print line immediately after the line is inked by the inkjet pen which heater means are sufficient to only partially dry the printed porous sheet medium; and an auxiliary heating means for heating the printed surfaces of sheets after printing, the auxiliary heating means including at least one heated roller member which is mounted for rolling contact with the printed surface of sheets and a second roller member mounted so that printed sheets pass through the nip between the first and second roller members with the pressure and heat along the nip between the first heated roller member and the second roller member providing an ironing effect that removes moisture to fully dry the printed porous sheet medium and to flatten cockles therein.

13. A printing system according to claim 12 wherein the inkjet pen is mounted between the first and second heater means.

* * * * *